US008328740B2

(12) United States Patent
Wu

(10) Patent No.: US 8,328,740 B2
(45) Date of Patent: Dec. 11, 2012

(54) SPA MACHINE WITH A PRESSURE-BALANCING WATERTIGHT ELECTRIC CONTROL DEVICE

(76) Inventor: Tsai Ying Wu, Jhonghe (TW)

( * ) Notice: Subject to any disclaimer, the term of this patent is extended or adjusted under 35 U.S.C. 154(b) by 1199 days.

(21) Appl. No.: 12/164,222

(22) Filed: Jun. 30, 2008

(65) Prior Publication Data

US 2009/0320201 A1 Dec. 31, 2009

(51) Int. Cl.
*A61H 9/00* (2006.01)
*A61H 7/00* (2006.01)

(52) U.S. Cl. ..... 601/154; 601/167; 601/169

(58) Field of Classification Search ..... 601/154–161, 601/167–169; 4/492, 496, 541.1–541.6; 607/80–82, 85–87; 174/50
See application file for complete search history.

(56) References Cited

U.S. PATENT DOCUMENTS 3,705,578 A * 12/1972 Cutler et al. ..... 601/73
3,754,548 A * 8/1973 McGrath ..... 601/154
3,820,173 A * 6/1974 Weller ..... 4/496
4,057,053 A * 11/1977 Kunz ..... 601/27
5,385,532 A * 1/1995 Shyu ..... 601/160
5,729,841 A * 3/1998 Chan ..... 4/622
6,234,986 B1 * 5/2001 Raffo et al. ..... 601/72
6,387,063 B1 * 5/2002 Elnar ..... 601/99
7,380,294 B2 * 6/2008 Lev et al. ..... 4/622
2009/0139020 A1 * 6/2009 Faulstich ..... 4/541.6

* cited by examiner

*Primary Examiner* — Justine Yu
*Assistant Examiner* — Valerie L Skorupa
(74) *Attorney, Agent, or Firm* — Ming Chow; Sinorica, LLC

(57) ABSTRACT

A SPA machine includes a housing provided with a water sprayer, a water pump mounted in the housing for pumping water out of the water sprayer, and a pressure-balancing watertight electric control device formed of a box, watertight buttons, an electric control unit, a watertight panel and a locating frame and mounted the housing for controlling the operation of the water pump and having a variable inside space automatically regulated subject to the external water pressure to prevent water penetration and to avoid electric leakage.

7 Claims, 7 Drawing Sheets

SPA MACHINE WITH A PRESSURE-BALANCING WATERTIGHT ELECTRIC CONTROL DEVICE

BACKGROUND OF THE INVENTION

1. Field of the Invention

The present invention relates to SPA technology and more particularly, to a SPA machine with a pressure-balancing watertight electric control device.

2. Description of the Related Art

Under the pressure in workplace and the life stress, people are frequently in a tense condition. When constantly suffering from a stress, a person tends to get depression. Therefore, everyone needs to find a little spare time for relaxing in each day. Many methods such as exercising, massaging, foot-bathing, and etc., are known effective to relieve stress. Everyone may select different time and method to relieve stress.

Bathing in a bathtub or boot-bathing in a boot-bathing apparatus helps relieve sweating, achieving stress relief effect. Many SPA machines including bubble generating devices, water spraying/vibrating devices, and etc., are commercially available for home application. These SPA machines are electrically to work under water. For working under water, watertight arrangement is critical to prevent water penetration. However, the internal holding space of any of a variety of conventional SPA machines is fixed. When the water level rises, the pressure of water is relatively increased. When a SPA machine bears an excessively high water pressure, water may penetrate through gaps into the inside of the machine, causing an electric leakage. Conventional SPA machines commonly use O-rings or gasket rings to seal parts against water. To achieve a better watertight effect, a high packing force is necessary. In this case, the dimension and structural strength must be relatively increased. However, increasing the dimension and structural strength relatively increases the fabrication and installation cost. Further, O-rings and gasket rings wear quickly with use. After a long use of a SPA machine, water may penetrate through gaps among parts, more particularly, around the power cord or operating buttons. Therefore, an improvement in this regard is necessary.

SUMMARY OF THE INVENTION

The present invention has been accomplished under the circumstances in view. It is one object of the present invention to provide a pressure-balancing watertight electric control device for SPA machine, which automatically regulates the inside holding space subject to the external water pressure, preventing water penetration and avoiding electric leakage.

It is another object of the present invention to provide a SPA machine with a pressure-balancing watertight electric control device, which matches with an electric device such as remote controller, connector, switch means, power source means, and etc. for use under water, prolonging the service life of the electric device.

To achieve these and other objects of the present invention, a pressure-balancing watertight electric control device is provide mounted in a SPA machine for controlling operation of the SPA machine. The pressure-balancing watertight electric control device comprises a box, which comprises an opening and at least one button hole cut through a bottom side thereof, at least one watertight button respectively installed in the at least one button hole of the box and extending to the outside of the box for operation by a user, an electric control unit mounted inside the box and electrically connected to the at least one watertight button and controllable by the at least one watertight button, a watertight panel, which is fastened to the box to seal the opening of the box and comprises a protruding diaphragm movable inwards/outwards to regulate the internal holding space of the box subject to the external pressure acted upon the protruding diaphragm, and a locating frame fastened to the box to hold down the watertight panel in the opening of the box. Further, the locating frame has an opening that receives the protruding diaphragm of the watertight panel.

By means of the effect of the protruding diaphragm of the watertight panel that moves inwards/outwards to regulate the internal holding space of the box subject to the external pressure, the internal air pressure of the pressure-balancing watertight electric control device is constantly kept in balance with the external pressure, preventing water penetration.

By means of the effect of the watertight panel, the pressure-balancing watertight electric control device prevents water penetration and avoids electric leakage, prolonging the service life of the SPA machine.

DETAILED DESCRIPTION OF THE PREFERRED EMBODIMENT

Figure 1:
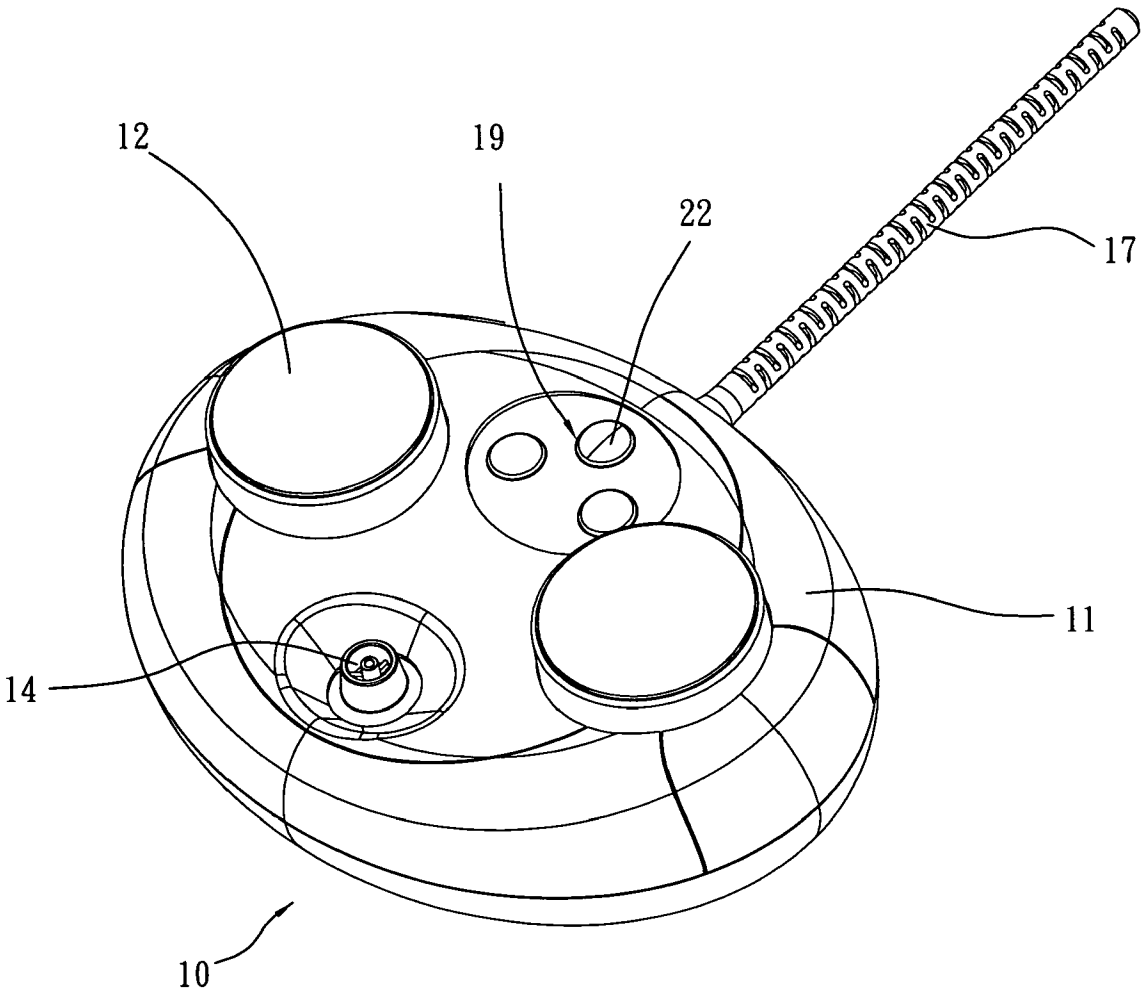
FIG. 1 is an oblique top elevation of a SPA machine in accordance with the present invention.
Figure 2:
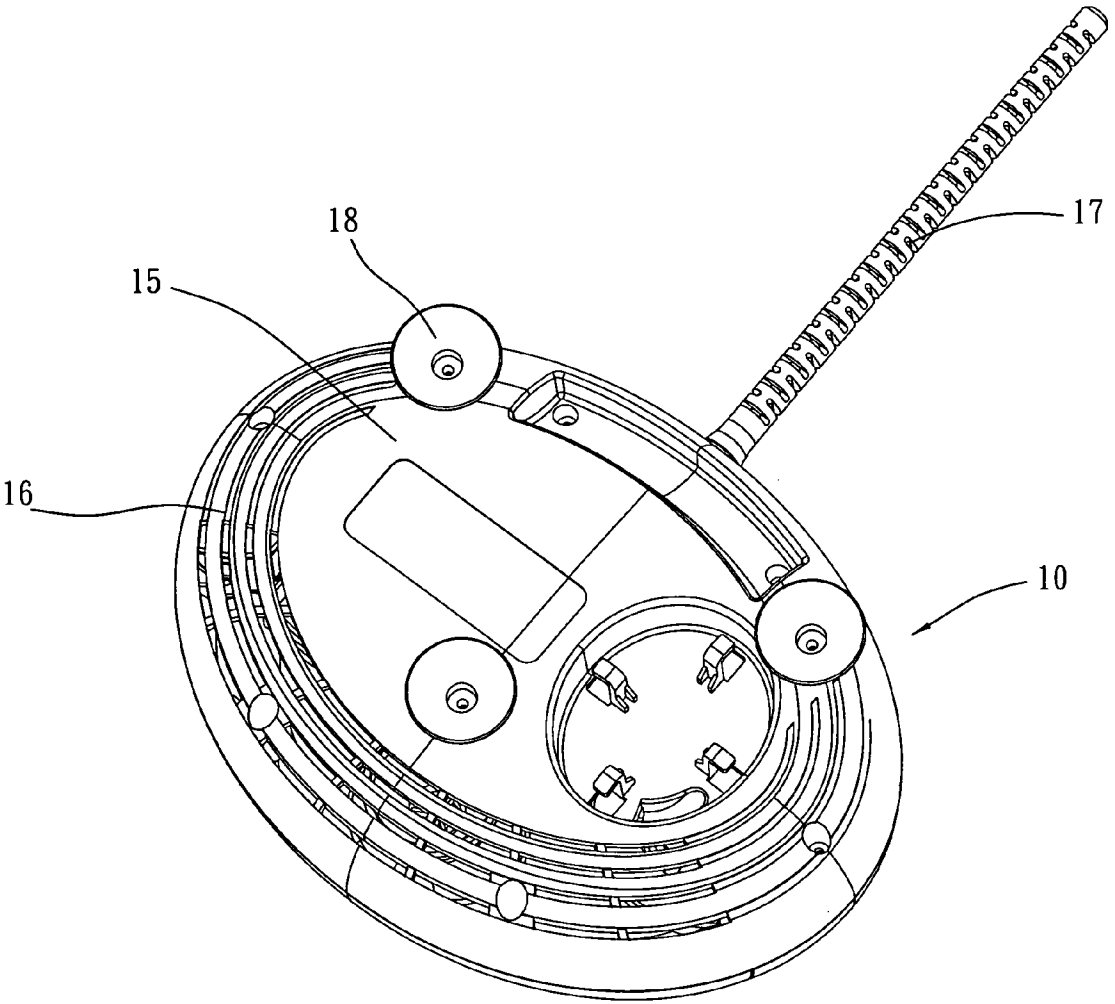
FIG. 2 is an oblique bottom elevation of the SPA machine in accordance with the present invention.
Figure 3:
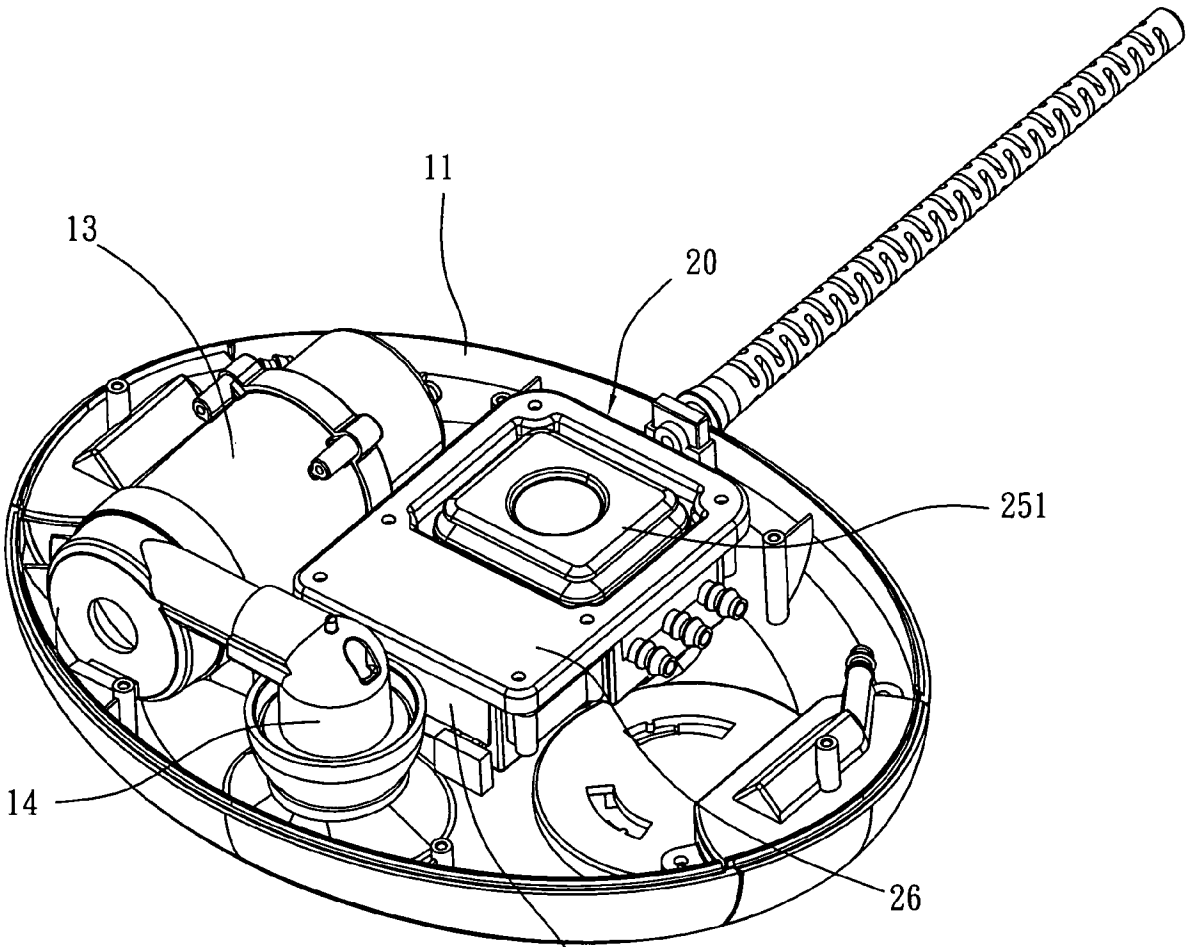
FIG. 3 illustrates the internal arrangement of the pressure-balancing watertight electric control device of the SPA machine after removal of the second cover shell.

Referring to FIGS. 1~3, a SPA machine 10 is shown adapted for use under water to stir, vibrate and spray water and to generate water bubbles. The SPA machine 10 comprises a first cover shell 11 and a second cover shell 15, and an pressure-balancing watertight electric control device 20 mounted in between the first cover shell 11 and the second cover shell 15. The first cover shell 11 has a water pump 13 mounted on the inner side thereof, and a water sprayer 14 mounted on the outer side thereof. The water sprayer 14 is coupled to the water pump 13. The second cover shell 15 defines at least one water passage 16, and has a power cord 17 connected thereto in a watertight manner. The second cover shell 15 and the first cover shell 11 are fastened together, thereby forming the SPA machine 10.

Referring to FIGS. 1~3 again, the first outer shell 11 has a plurality of massaging blocks 12 arranged on the outer side. The water pump 13 is controllable to pump water out of the water sprayer 14 for massaging the body of a person. The at least one water passage 16 is formed on the inner side of the second cover shell 15 for enabling the water pump 13 to pump water in water. Further, vacuum mounts 18 are provided at the outer side of the second cover shell 15 for securing the SPA machine 10 to the inner bottom side of a bathtub (not shown) by means of a vacuum suction force.

Referring to FIGS. 4~7, the pressure-balancing watertight electric control device 20 comprises a box 21, at least one watertight button 22, an electric control unit 24, a watertight panel 25, and a locating frame 26. The box 21 has an opening 211 and at least one button hole 213. The button hole 213 is formed on the bottom side of the box 21. The at least one watertight button 22 is coupled to the button hole 213. The electric control unit 24 is coupled to the at least one watertight button 22 inside the box 21. The watertight panel 25 has a protruding diaphragm 251. Further, the watertight panel 25 fits the contour of the opening 211 of the box 21, and is affixed to the box 21 to seal the opening 211 of the box 21 in a watertight manner. The locating frame 26 is fastened to the box 21 to hold down the watertight panel 25 in the opening 211, having an opening 260 that accommodates the protruding diaphragm 251 of the watertight panel 25.

The protruding diaphragm 251 of the watertight panel 25 moves forwards/backwards to adjust the internal space of the box 21 subject to the pressure of outside water, keeping the internal air pressure in balance with the external water pressure, achieving optimal watertight effect and for allowing operation of the at least one watertight button 22 to control the electric control unit 24.

The pressure-balancing watertight electric control device 20 further comprises an eccentric motor 23. The eccentric motor 23 is mounted inside the box 21 and electrically connected to the power cord 17 for vibrating the massaging blocks 12 to massage the user.

Further, the watertight panel 25 is made of an elastic material, such as silicon rubber, rubber, or flexible plastics. According to the present preferred embodiment, the number of the at least one button hole 213 of the box 21 is 3, and the number of the at least one watertight button 22 is also 3. The three watertight buttons 22 are respectively inserted through the button holes 213 of the box 21(see FIG. 1).

Further, the first cover shell 11 has three through holes 19 through which the three watertight buttons 22 extend to the outside of the SPA machine 10 for enabling the user to control the operation of the electric control unit 24 conveniently.

Figure 5:
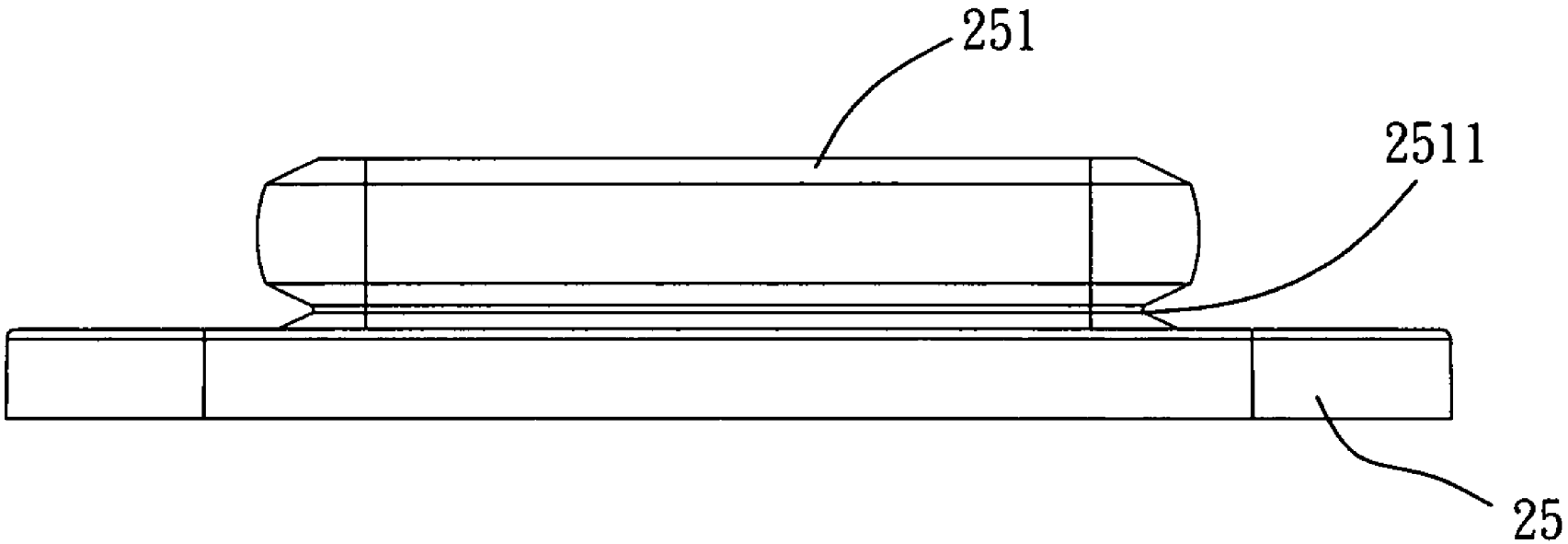
FIG. 5 is a schematic plain view of the watertight panel of the pressure-balancing watertight electric control device of the SPA machine in accordance with the present invention.
Figure 6:
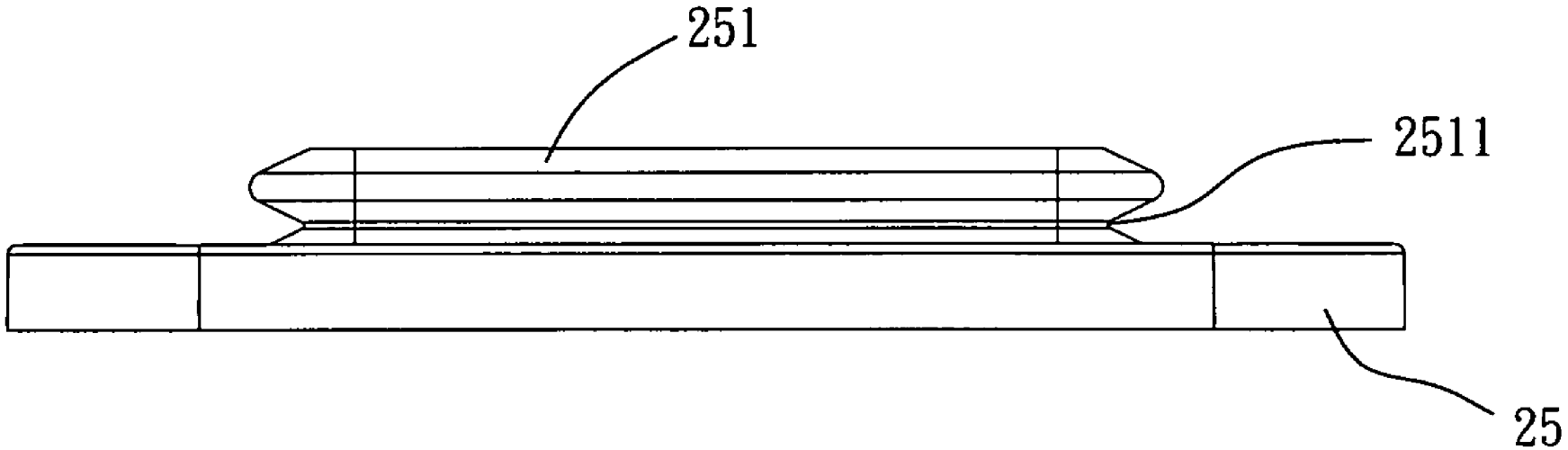
FIG. 6 corresponds to FIG. 5, showing the watertight panel compressed.
Figure 7:
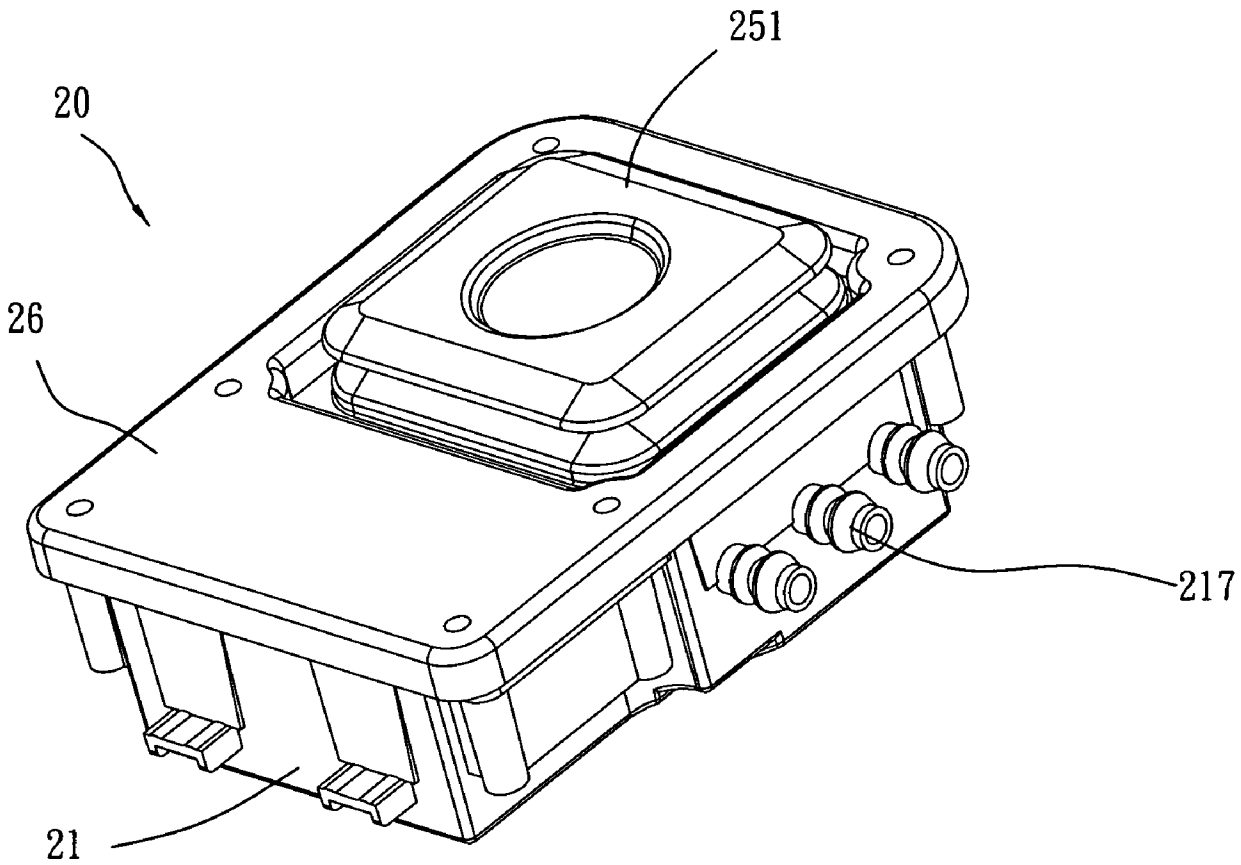
FIG. 7 is a schematic assembly view of the pressure-balancing watertight electric control device of the SPA machine in accordance with the present invention.

Referring to FIGS. 5 and 6, the protruding diaphragm 251 has a bottom deformable portion 2511 connected to the watertight panel 25, enhancing the deformability of the protruding diaphragm 251. Therefore, the protruding diaphragm 251 is highly movable to adjust the internal space of the box 21 subject to the pressure of outside water, keeping the internal air pressure in balance with the external water pressure.

Referring to FIGS. 1 and 3 again, after installation of the pressure-balancing watertight electric control device 20 in the SPA machine 10, the pressure-balancing watertight electric control device 20 is electrically connected with the power cord 17 in a watertight manner, and the power cord 17 extends out of the SPA machine 10 for connection to an external power source.

Referring to FIGS. 3~6 again, by means of the vacuum mounts 18, the SPA machine 10 is fastened to the inner bottom side of a bathtub (not shown). When filling water into the bathtub, the pressure of water in the bathtub is increasing subject to water level rise, and at the same time the water pressure received by the pressure-balancing watertight electric control device 20 of the SPA machine 10 is relatively increasing. When the water pressure is increasing, the protruding diaphragm 251 of the watertight panel 25 is forced to move backwards and to adjust the internal space of the box 21 and to compress the bottom deformable portion 2511, thereby regulating the internal space of the box 21 and keeping the internal air pressure of the pressure-balancing watertight electric control device 20 in balance with the water pressure in the bathtub. Therefore, the watertight panel 25 effectively prohibits water from entering the inside of the electric control unit 24, avoiding electrical leakage or damage. When the watertight panel 25 of the pressure-balancing watertight electric control device 20 is kept away from water pressure, the elastic material property automatically returns the protruding diaphragm 251 of the watertight panel 25 to its former shape, keeping the internal space in balance with the atmospheric pressure.

Subject to the aforesaid design and description, the pressure-balancing watertight electric control device 20 of the SPA machine 10 constantly keeps its internal air pressure in balance with the outside water, avoiding water leakage. The invention eliminates the use of an O-ring or gasket ring to prevent water penetration. Therefore, the invention effectively prevents water penetration, avoiding electric leakage and prolonging the service life of the machine.

Further, the box 21 has a plurality of screw holes 215 on the top side around the opening 211. The watertight panel 25 has a plurality of mounting through holes 253 corresponding to the screw holes 215. The locating frame 26 has a plurality of mounting through holes 261 respectively fastened to the mounting through holes 253 of the watertight panel 25 and the screw holes 215 of the box 21 of the pressure-balancing watertight electric control device 20 with screws (see FIGS. 3 and 4).

Figure 4:
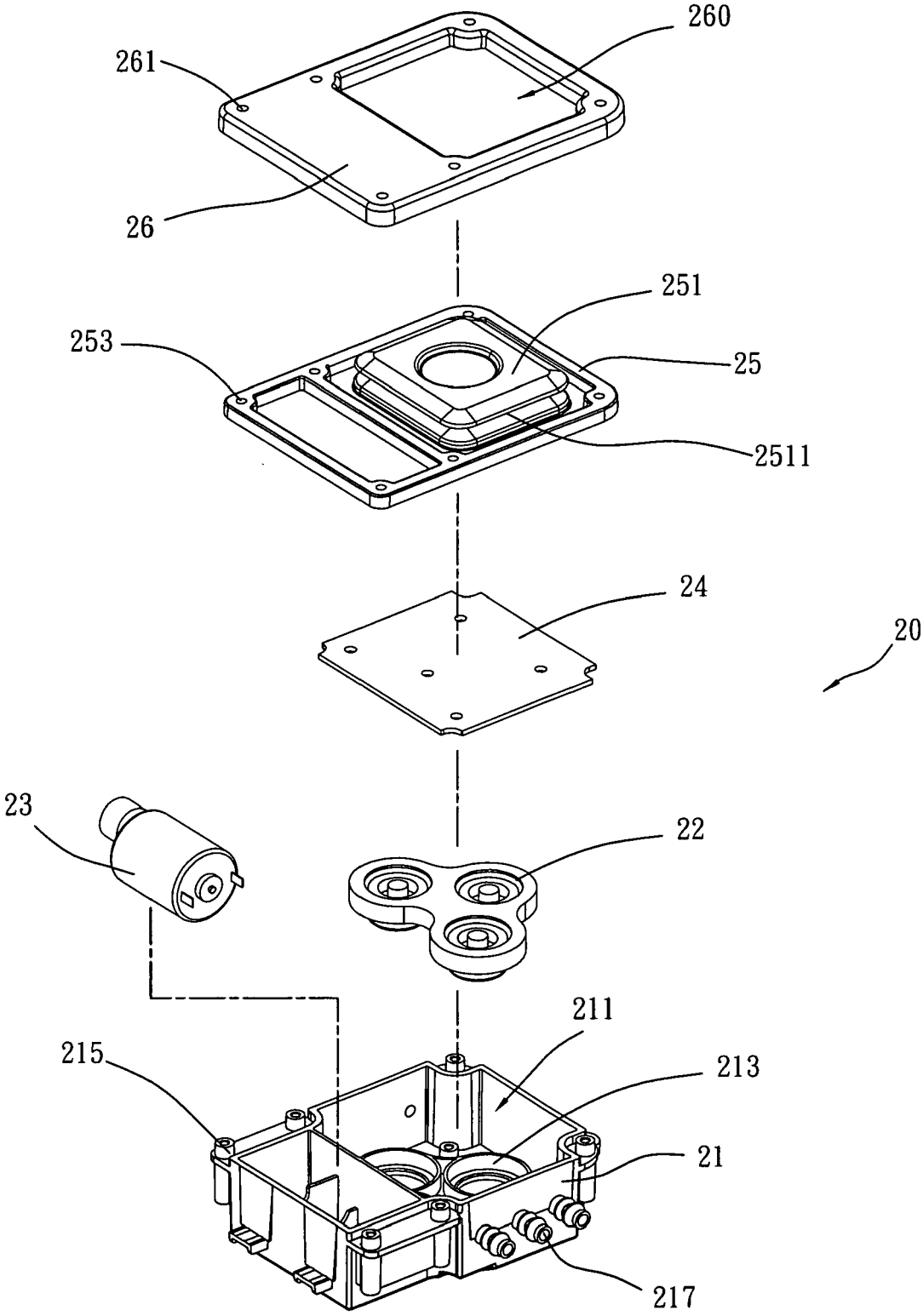
FIG. 4 is an exploded view of the pressure-balancing watertight electric control device of the SPA machine in accordance with the present invention.

Further, the box 21 of the pressure-balancing watertight electric control device 20 is provided with at least one electric power connector 217 for the connection of external power circuit means in a watertight manner (see FIG. 4).

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A pressure-balancing watertight electric control device mounted in a SPA machine for controlling operation of said SPA machine, the pressure-balancing watertight electric control device comprising:

a box, said box comprising an opening and at least one button hole cut through a bottom side thereof;

at least one watertight button respectively installed in said at least one button hole of said box and extending to the outside of said box for operation by a user;

an electric control unit mounted inside said box and electrically connected to said at least one watertight button and controllable by said at least one watertight button;

a watertight panel fastened to said box to seal said opening of said box, said watertight panel comprising a protruding diaphragm movable inwards/outwards to regulate the internal holding space of said box subject to an external water pressure acted upon said protruding diaphragm;

a locating frame fastened to said watertight panel and said box to hold down said watertight panel in said opening of said box and seal said box to prevent water entering said box, said locating frame having an opening that receives said protruding diaphragm of said watertight panel; and an eccentric motor mounted in said box and electrically connected to said electric control unit, wherein said protruding diaphragm has a bottom deformable portion connected to said watertight panel; and said box is mounted with at least one electric power connector in a watertight manner for the connection of said electric control unit electrically.

2. The pressure-balancing watertight electric control device as claimed in claim 1, wherein said watertight panel is made of an elastic material.

3. The pressure-balancing watertight electric control device as claimed in claim 2, wherein said elastic material is selected from the group of silicon rubber, rubber and elastic plastics.

4. The pressure-balancing watertight electric control device as claimed in claim 1, wherein the number of said at least one button hole of said box is 3; the number of said at least one at least one watertight button is 3.

5. The pressure-balancing watertight electric control device as claimed in claim 1, wherein said box comprises a plurality of screw holes arranged around said opening of said box; said locating frame comprises a plurality of mounting through holes respectively fastened to the screw holes of said box with screws.

6. A spa machine comprising:

a housing formed of a first cover shell and a second cover shell, said second cover shell comprising at least one water passage;

a water sprayer mounted in an outer side of said first cover shell outside said housing;

a water pump affixed to an inner side of said first cover shell inside said housing and connected with said water sprayer and adapted for pumping water out of said water sprayer through said at least one water passage; and a pressure-balancing watertight electric control device mounted inside said housing and adapted for controlling operation of said water pump, said pressure-balancing watertight electric control device comprising:

a box, said box comprising an opening and at least one button hole cut through a bottom side thereof;

at least one watertight button respectively installed in said at least one button hole of said box and extending to the outside of said box and said first cover shell for operation by a user;

an electric control unit mounted inside said box and electrically connected to said at least one watertight button and controllable by said at least one watertight button to control the operation of said water pump;

a watertight panel fastened to said box to seal said opening of said box, said watertight panel comprising a protruding diaphragm movable inwards/outwards to regulate the internal holding space of said box subject to an external water pressure acted upon said protruding diaphragm; and a locating frame fastened to said watertight panel and said box to hold down said watertight panel in said opening of said box and seal said box to prevent water entering said box, said locating frame having an opening that receives said protruding diaphragm of said watertight panel; and an eccentric motor mounted in said box and electrically connected to said electric control unit, wherein said first cover shell is provided with at least one movable massaging blocks extended out of said housing and movable by said eccentric motor.

7. The SPA machine as claimed in claim 6, wherein said second cover shell has an outer side provided with at least one vacuum mount for fastening said SPA machine to a flat surface by means of a vacuum suction force.

* * * * *